US009134704B2

(12) United States Patent
Aizawa et al.

(10) Patent No.: US 9,134,704 B2
(45) Date of Patent: Sep. 15, 2015

(54) ELECTRONIC DEVICE WITH ANTENNA

(71) Applicant: Seiko Epson Corporation, Tokyo (JP)

(72) Inventors: Tadashi Aizawa, Nagano-ken (JP); Masayuki Ikeda, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 223 days.

(21) Appl. No.: 13/901,318

(22) Filed: May 23, 2013

(65) Prior Publication Data

US 2013/0322217 A1 Dec. 5, 2013

(30) Foreign Application Priority Data

May 29, 2012 (JP) ..... 2012-121660

(51) Int. Cl.
*H01Q 1/12* (2006.01)
*G04B 47/00* (2006.01)
*G04R 60/10* (2013.01)

(52) U.S. Cl.
CPC ..... *G04B 47/00* (2013.01); *G04R 60/10* (2013.01)

(58) Field of Classification Search
CPC ..... G04B 47/00; G04B 60/10
USPC ..... 343/718, 700 MS, 702
See application file for complete search history.

(56) References Cited

U.S. PATENT DOCUMENTS

| | | | | |
|---|---|---|---|---|
| 7,019,702 | B2 * | 3/2006 | Henriet et al. | 343/718 |
| 7,425,922 | B1 * | 9/2008 | Adams | 343/700 MS |
| 2006/0227058 | A1 * | 10/2006 | Zellweger et al. | 343/718 |
| 2009/0184883 | A1 * | 7/2009 | Liu | 343/893 |

FOREIGN PATENT DOCUMENTS

JP 10-197662 A 7/1998

* cited by examiner

*Primary Examiner* — Hoanganh Le

(57) ABSTRACT

A small electronic device enables improving transmission and reception performance with stable operation. An example of the electronic device is an electronic wristwatch having a display; a circuit board disposed on one side of the display; an antenna is disposed on the opposite side of the circuit board as the display, and includes a dielectric layer, a ground conductor disposed on one side of the dielectric layer, and a radiating conductor disposed on the other side of the dielectric layer. The ground conductor is disposed on the surface of the dielectric layer on the side near the circuit board, and is connected to the ground potential of the circuit board. The radiating conductor is disposed on the surface of the dielectric layer on the side far from the circuit board, and is connected to the signal potential of the circuit board.

3 Claims, 6 Drawing Sheets

ELECTRONIC DEVICE WITH ANTENNA

CROSS REFERENCE TO RELATED APPLICATION

This application claims priority to Japanese Application No. 2012-121660, filed May 29, 2012, the entirety of which is incorporated by reference herein.

BACKGROUND

1. Technical Field

The present invention relates to a device with an antenna function, and relates more particularly to an electronic device that is primarily worn by a person or animal when used.

2. Related Art

Japanese Unexamined Patent Appl. Pub. JP-A-H10-197662 discloses a mobile receiver device as an example of an electronic device that has an internal antenna and is used worn on the arm. This mobile receiver device has a circuit board with a sandwich structure having an electromagnetic shield layer inserted between the front and back sides of the circuit board, a digital circuit unit and a reception antenna disposed on one side of the circuit board as part of a receiver circuit, and an analog circuit unit forming another part of the receiver circuit disposed on the other side of the circuit board opposite the reception antenna with the circuit therebetween. The analog circuit unit that is easily affected by noise is electromagnetically shielded from the digital circuit unit that is a source of high frequency digital noise by the electromagnetic shield layer embedded in the circuit board in this mobile receiver device, and leakage or mixing of noise from the digital circuit unit to the analog circuit unit is effectively suppressed by this electromagnetic shielding. The digital circuit unit and analog circuit unit can therefore be disposed close together in this mobile receiver device to increase the packaging density and reduce device size while reception performance is also improved by reducing or eliminating the effect of noise.

However, while the technology of the related art enables suppressing the effect of the digital circuit unit and making the mobile receiver device small, further reducing the size using the general configuration taught in JP-A-H10-197662, and more specifically a configuration that connects an LCD panel or other display unit to the reception antenna side with a flat cable, is impeded by the effect of the LCD panel or flat cable on the reception antenna causing impedance to fluctuate and degrading radiation efficiency.

Another problem with the above technology is that the size of the display unit is limited by the antenna, display unit, and digital circuits being disposed side by side on a flat surface. As a result, a large amount of information cannot be presented on the display unit in an advanced, high performance electronic device, and the design and appearance of the outside case of the electronic device is also severely limited. This is because of technical constraints that require the conventional reception antenna to be disposed near the surface of the outside case in order to receive signals. Yet further, in an electronic device that is worn by a person or animal when used, the transmission and reception performance of the antenna must not vary greatly according to how the device is worn.

SUMMARY

The present invention is directed to solving at least part of the foregoing problems by means of the embodiments and configurations described below.

An electronic device according to one aspect of the invention includes a display unit that displays information; a circuit board disposed on one side of the display unit; an antenna unit that does at least one of transmitting and receiving radio waves, is disposed on the opposite side of the circuit board as the display unit, and includes a planar-shaped dielectric layer, a first conductive layer disposed on one side of the dielectric layer, and a second conductive layer disposed on the other side of the dielectric layer; and a battery that is disposed on the opposite side of the antenna unit as the circuit board and supplies power; wherein the first conductive layer is disposed on the surface of the dielectric layer on the side near the circuit board, and is connected to the ground potential of the circuit board, and the second conductive layer is disposed on the surface of the dielectric layer on the side far from the circuit board, and is connected to the signal potential of the circuit board.

In the electronic device according to this aspect of the invention the antenna unit includes a planar-shaped dielectric layer, a first conductive layer disposed on one side of the dielectric layer, and a second conductive layer disposed on the other side of the dielectric layer, and can be disposed stacked between the circuit board and battery disposed in order on one side of the display unit. Substantially the entire top side of the electronic device can therefore be occupied by the display unit, and a large amount of information can be displayed.

The battery is also preferably located near the exterior case because the battery will need replacing. By disposing the antenna unit and the circuit board between the display unit and battery that should be located near the surface of the exterior case of the electronic device, the battery can be easily installed and removed.

Because the display unit and the circuit board are close together with this configuration, multiple connections therebetween can be easily made. A suitable shield layer can also be disposed between the antenna unit and the display unit, which is an easy source of noise, and noise from the display unit can be prevented from reaching the antenna unit.

The first conductive layer that is at the ground potential, and the second conductive layer that is at the signal potential, at the operating frequency of the electronic device are also separated by the dielectric layer of the antenna unit. More specifically, at the operating frequency the display unit and the first conductive layer of the antenna unit close to the circuit board go to the ground potential of the circuit board, and the second conductive layer of the antenna unit that is far from the circuit board goes to the signal potential of the circuit board. This configuration minimizes the number of connection lines in the electronic device that straddle both the first conductive layer and the second conductive layer of the antenna unit and can short the potential of each, and minimizes disruption of the electromagnetic field distribution induced in the first conductive layer and second conductive layer of the antenna unit. A high functionality electronic device that maximizes the performance of the antenna unit can therefore be achieved.

Another aspect of the invention is an electronic device including: a display unit that displays information; an antenna unit that does at least one of transmitting and receiving radio waves, is disposed on one side of the display unit, and includes a planar-shaped dielectric layer, a first conductive layer disposed on one side of the dielectric layer, and a second conductive layer disposed on the other side of the dielectric layer; a circuit board disposed on the opposite side of the antenna unit as the display unit; and a battery that is disposed on the opposite side of the circuit board as the antenna unit and supplies power; wherein the first conductive layer is disposed on the surface of the dielectric layer on the side near the circuit board, and is connected to the ground potential of the circuit board, and the second conductive layer is disposed on the surface of the dielectric layer on the side far from the circuit board, and is connected to the signal potential of the circuit board.

In the electronic device according to this aspect of the invention the antenna unit includes a planar-shaped dielectric layer, a first conductive layer disposed on one side of the dielectric layer, and a second conductive layer disposed on the other side of the dielectric layer, and can be disposed stacked between the display unit and the circuit board disposed on one side of the display unit. Substantially the entire top side of the electronic device can therefore be occupied by the display unit, and a large amount of information can be displayed.

The battery is also preferably located near the exterior case because the battery will need replacing. By disposing the antenna unit and the circuit board between the display unit and battery that should be located near the surface of the exterior case of the electronic device, the battery can be easily installed and removed.

The first conductive layer of the antenna unit in this configuration is also disposed on the side facing the circuit board, and is connected to the ground potential of the circuit board. As a result, when the electronic device is worn on the wrist or other body part, the effect of the body part on electronic device operation can be reduced.

Further preferably in another aspect of the invention, the shape of the dielectric layer of the antenna unit, and the shape of at least one of the first conductive layer and the second conductive layer, is a rectangle with n (where n is 0, 1, 2, 3, or 4) truncated corners, and at least a short side of the rectangle is disposed outside of a position 2/100 wavelength of the radio wave inside from the outside edge of the larger of the conductors formed on the display unit or the circuit board.

The shape of the display surface of the display unit in the electronic device is preferably rectangular in this aspect of the invention, and if the antenna unit, circuit board, and display unit all have the same shape, these components can be efficiently housed in the exterior case of the electronic device. When the electronic device is basically rectangular and the corners must be rounded, the corners of the antenna unit and circuit board can be appropriately truncated as needed. When the antenna unit is a planar antenna, the magnetic current produced along the outside edges of the antenna unit determine antenna performance. Simulations have shown that the performance of the antenna unit can be maintained in this implementation if the outside edges of the antenna unit are disposed on the outside of a position 2/100 wavelength of the received radio waves inside of the outside edge of the larger of the conductors formed on the display unit and circuit board. A compact electronic device with an excellent exterior appearance can therefore be achieved with this aspect of the invention without adversely affecting antenna performance.

An electronic device according to another aspect of the invention preferably also has a conductor that is larger than the outside shape of the largest of the display unit, the circuit board, and the antenna unit, and is disposed on the opposite side of the battery as the circuit board.

The conductor included in the electronic device according to this aspect of the invention works to assure a dependable ground potential and thereby stabilize operation of the electronic device. This conductor could be metal or other conductive material that is part of the exterior case of the electronic device.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of an electronic device according to the present invention are described below with reference to the accompanying figures. An electronic device compatible with a communication system that receives and uses positioning signals carried by radio frequency signals transmitted from positioning information satellites, for example, is described below as an example of an electronic device according to the invention. The communication system in this example is the Global Positioning System (GPS).

Figure 1:
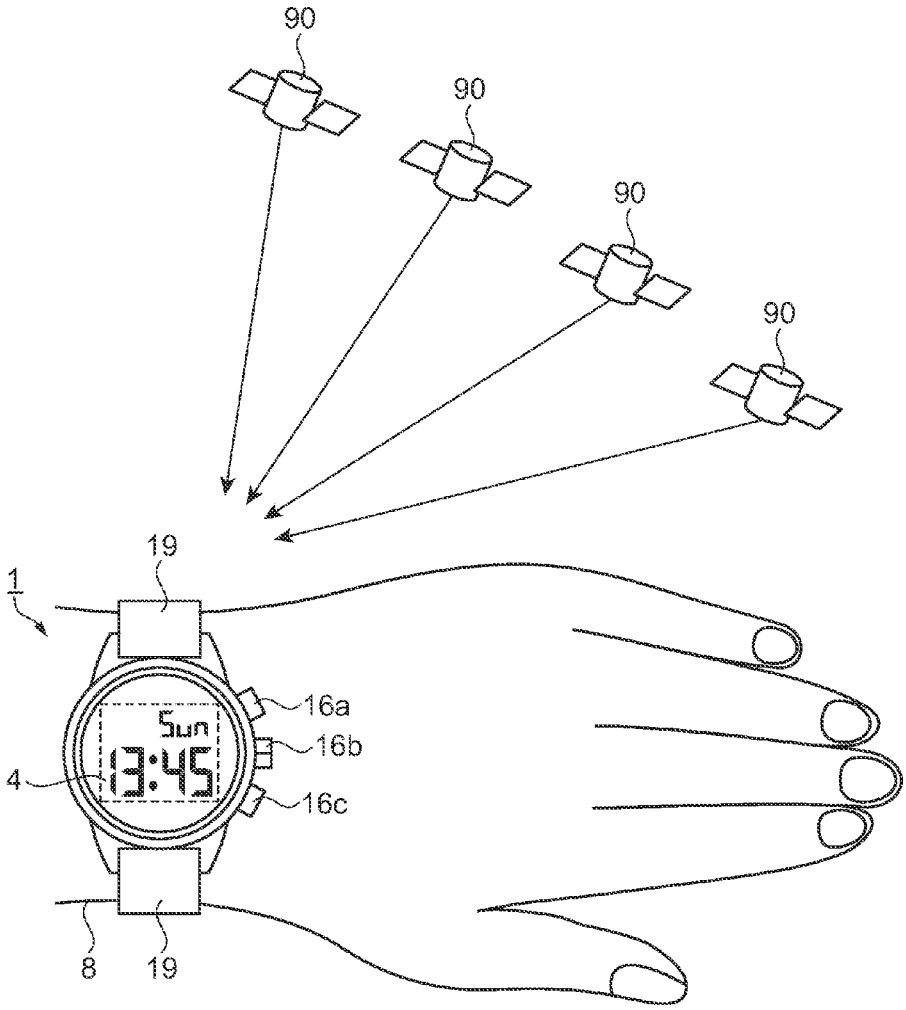
FIG. 1 shows the basic configuration of the GPS system.

FIG. 1 shows the basic configuration of the GPS system. As shown in FIG. 1, a GPS satellite 90 is a positioning information satellite that circles the Earth on a specific orbit, and transmits satellite signals having a navigation message superimposed on a 1.57542 GHz microwave signal. Each GPS satellite 90 carries an atomic clock, and GPS time information, which is extremely precise time information kept by the atomic clock, is contained in the satellite signal. An electronic wristwatch (electronic device) 1 that also functions as a GPS receiver can display accurate time information by receiving these satellite signals and adjusting any advance or delay in the time kept internally by the electronic wristwatch 1. This adjustment is done in a timekeeping mode.

Orbit information that indicates a specific position on the orbit of the GPS satellite 90 is also contained in the satellite signal. More specifically, the electronic wristwatch 1 also has a positioning function, and by receiving satellite signals transmitted from usually four or more GPS satellites 90 can calculate its position using the orbit information and GPS time information contained in the received signals. By calculating its position, the electronic wristwatch 1 can also easily adjust the time zone according to the current position. This adjustment is done in a positioning mode. The electronic wristwatch 1 can also perform a variety of other operations using these satellite signals, including displaying the current position, measuring distance travelled, and measuring the speed of travel, and can digitally display this information on an LCD panel unit 4 used as a display unit.

Embodiment 1

Figure 2:
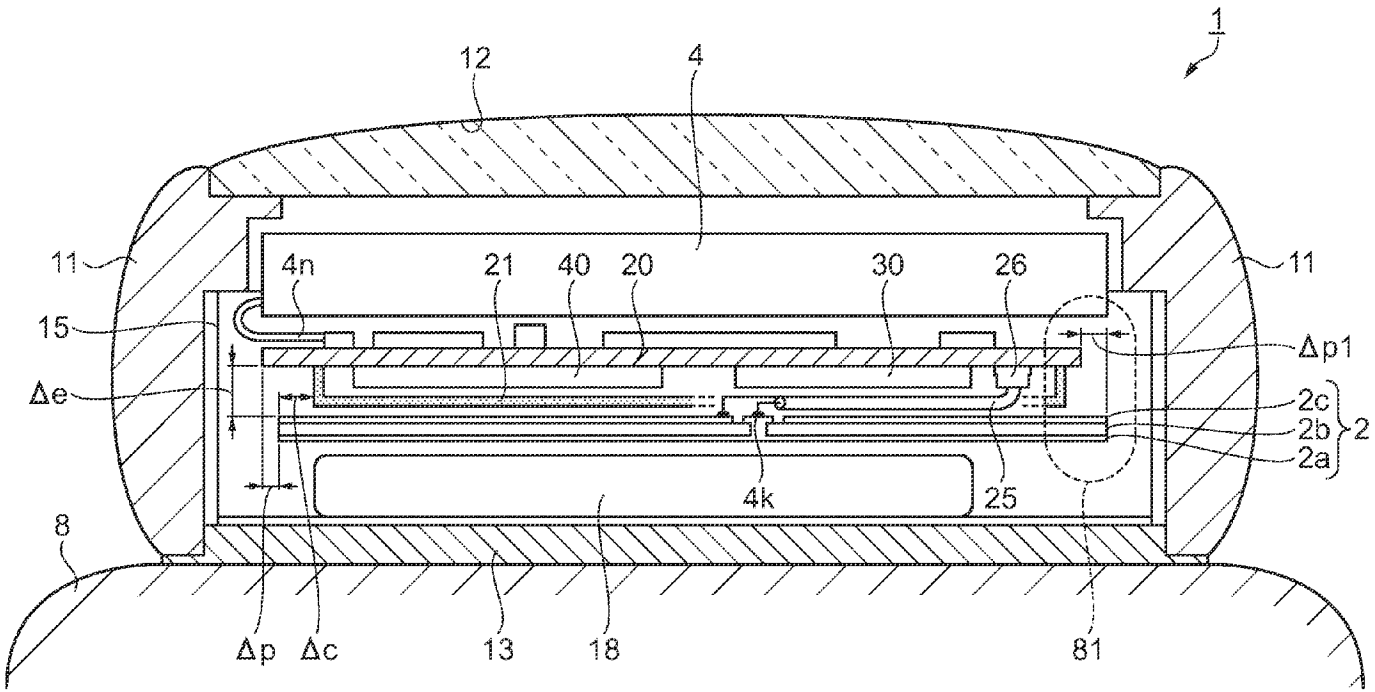
FIG. 2 is a section view of a configuration including an antenna unit in an electronic wristwatch according to a first embodiment of the invention.
Figure 4:
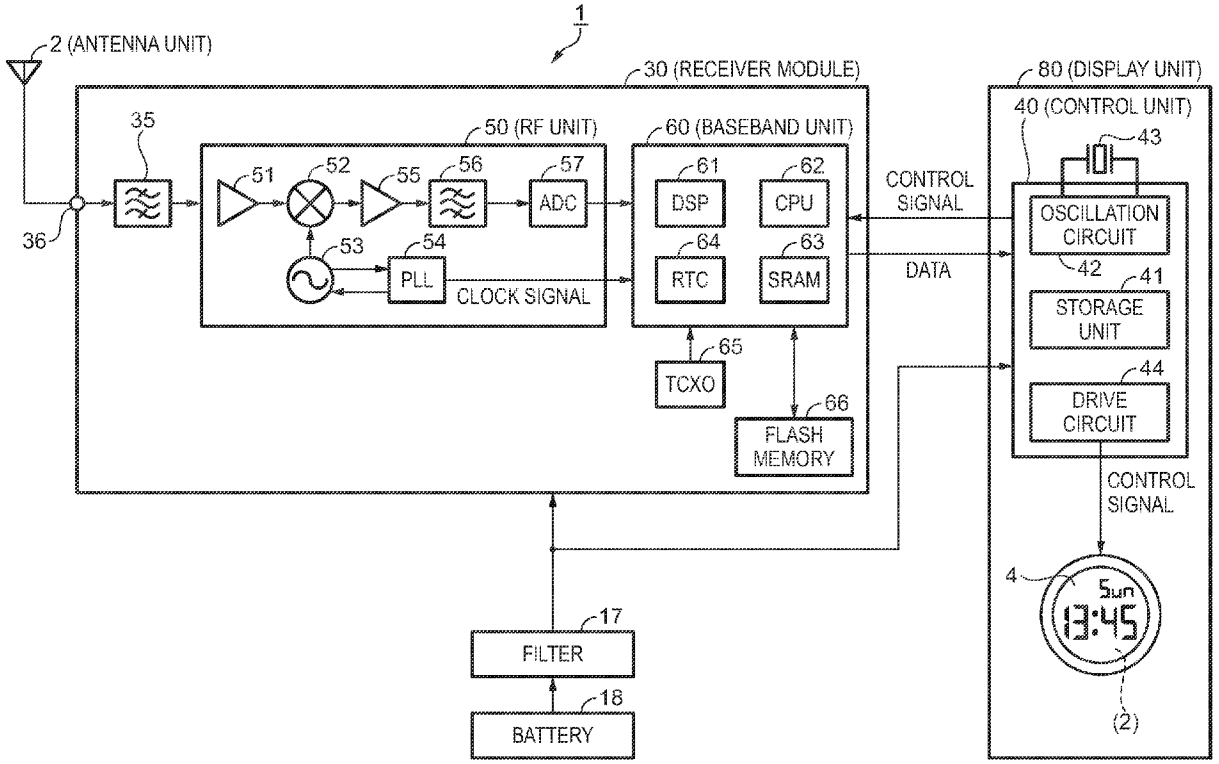
FIG. 4 is a block diagram showing the circuit configuration of the electronic wristwatch.

This first embodiment of the invention describes one example of the configuration of an electronic wristwatch 1 with a GPS receiver function. FIG. 2 is a section view showing the configuration including the antenna unit of an electronic wristwatch according to the first embodiment of the invention, and FIG. 4 is a block diagram showing the circuit design of the electronic wristwatch. Note that the vertical and horizontal scales differ in FIG. 2 in order to clearly describe the configuration of the electronic wristwatch, and particularly the configuration in the vertical direction (through the thickness of the wristwatch).

As shown in FIG. 2 and FIG. 1, the electronic wristwatch 1 with GPS receiver function has an outside case 11 made of plastic (such as polycarbonate) or other material through which radio waves pass easily and which is not electrically conductive, and a strap 19 for holding the outside case 11 on the wrist 8.

The outside case 11 includes a crystal 12 affixed to an opening on the face side of the case, which is the side on which the time and other displayed information can be seen; a back cover 13 affixed to the back side of the case, which is the side of the electronic wristwatch 1 worn against the wrist 8; and buttons 16*a*, 16*b*, 16*c* (FIG. 1) disposed to the side of the outside case 11. The outside case 11 has a substantially round, cylindrical shape, but could be a polygon (with rounded corners and edges), and is typically shaped to match the shape of the display when an LCD panel or other digital display is used. The buttons 16 (16*a*, 16*b*, 16*c*) are used to manually set the information displayed on the LCD panel unit 4, for example.

A drive mechanism for processing incrementing the time, and a processing mechanism for processing information and displaying the processed information, are supported by a support frame 15 inside the outside case 11. In order from the face side of the electronic wristwatch 1, the support frame 15 supports an LCD panel unit 4 for displaying the time and other information; a circuit board 20 that in a group including other circuit boards not shown is disposed closest to the LCD panel unit 4, and on the back cover side has a receiver module 30 and control unit 40 that are described below with reference to FIG. 4; a shield 21 that shields the receiver module 30 and control unit 40; an antenna unit 2 for receiving signals from GPS satellites 90; and a battery 18 that is the power supply source of the electronic wristwatch 1. The antenna unit 2, LCD panel unit 4, and circuit board 20 are substantially the same size, and more particularly are substantially congruent rectangles, and are held in the electronic wristwatch 1 inside the support frame 15, the outside of which is substantially round. Tabs (not shown in the figure) for positioning to the outside case 11 are disposed to the outside of the support frame 15, and the LCD panel unit 4 is thereby disposed to a specific position relative to the outside case 11. Note that the antenna unit 2, LCD panel unit 4, and circuit board 20 are more preferably the same size and shape, that is, are congruent, because packaging efficiency can thereby be increased.

The LCD panel unit 4 is disposed on the opposite side of the circuit board 20 as the antenna unit 2, and is connected through a flexible circuit 4*n* to a drive circuit 44 (FIG. 4) mounted on the circuit board 20. In order from the battery 18 side, the antenna unit 2 includes a conductor (second conductor layer) 2*a*, a planar-shaped dielectric layer (dielectric body) 2*b*, and another conductor (first conductor layer) 2*c*. Conductor 2*a* is connected through a through-hole formed in the dielectric layer 2*b* to a feed pin 4*k* on the other conductor 2*c* side of the dielectric layer 2*b*. The antenna unit 2 is connected to the receiver module 30 (FIG. 4) through a coaxial cable 25. The center conductor of one end of the coaxial cable 25 is connected to the feed pin 4*k*, and the outer conductor of the coaxial cable 25 is connected to the conductor 2*c* near the feed pin 4*k*. The other end of the center conductor of the coaxial cable 25 is connected to a SAW filter 35 through a signal terminal 36 that inputs the high frequency signals of the receiver module 30 through a connector 26, and the outer conductor is connected to the ground potential of the circuit board 20 through the connector 26.

Because the antenna unit 2 is disposed with the feed pin 4*k* on the side toward the circuit board 20, the antenna unit 2 and circuit board 20 can be easily connected. The resonance frequency of the antenna is also lowest when the size of the antenna unit 2 is limited and conductor 2*c*, dielectric layer 2*b*, and conductor 2*a* are the same size. Conductor 2*c* and conductor 2*a* are therefore preferably the same size because the size of the antenna unit 2 can be minimized, but conductor 2*c* could be larger than conductor 2*a*, or conductor 2*a* could be larger than conductor 2*c*. Using different size conductors enables tuning the resonance frequency of the antenna unit 2. Test simulations have also shown that when the outside case 11 is conductive, providing a gap of at least 1/200 of the wavelength of the electromagnetic waves at the resonance frequency between the outside edge of the dielectric layer 2*b* and the outside case 11 yields preferable performance characteristics.

In addition, at least the short side of the rectangular antenna unit 2 must not be placed inside of 2/100 or more of the wavelength of the electromagnetic waves from the outside edge of the larger of the circuit board 20 and LCD panel unit 4. The battery 18 must also be disposed so that it does not conceal the outside edge of the antenna unit 2. The configuration and reception function of the antenna unit 2 are described in further detail below with reference to FIG. 5.

Figure 3A:
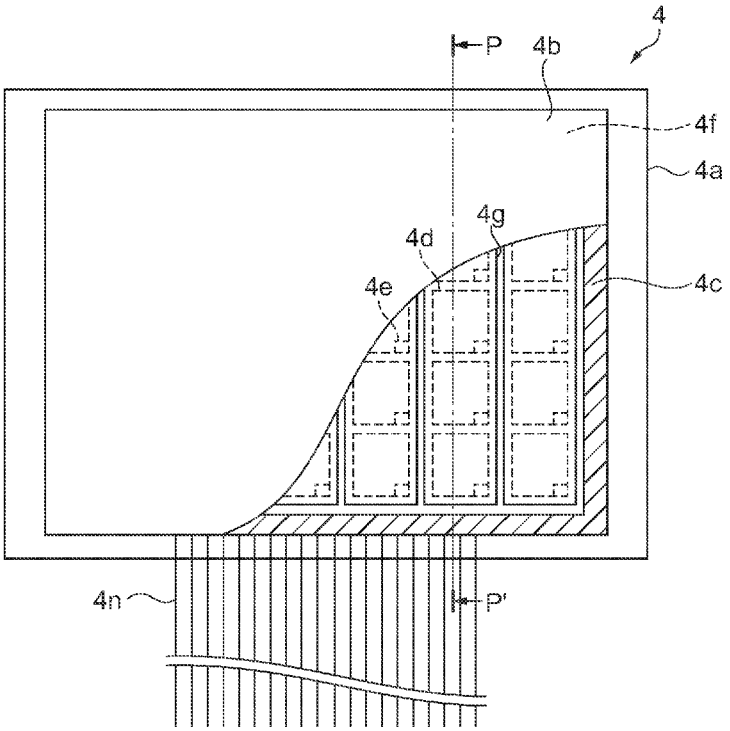
FIG. 3A is a plan view of the configuration of an LCD panel unit.
Figure 3B:
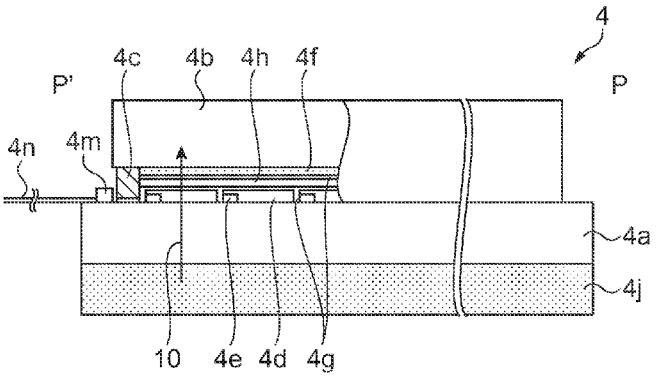
FIG. 3B shows the configuration of the LCD panel unit in section.

The LCD panel unit 4 is described next. FIG. 3A is a plan view showing the configuration of the LCD panel, and FIG. 3B is a section view showing the configuration of the LCD panel. FIG. 3B is a section view through line P-P' in FIG. 3A. As shown in FIG. 3A and FIG. 3B, the LCD panel unit 4 has a transparent substrate 4*a* and an opposing substrate 4*b* that is paired with and bonded to the transparent substrate 4*a* by a seal 4*c* (sealant). More specifically, the seal 4*c* creates a sealed space between the two substrates.

Inside the area framed by the seal 4*c*, the LCD panel unit 4 has a plurality of pixel electrodes (pixels) 4*d* disposed in a grid on the surface of the transparent substrate 4*a*; thin-film transistors (TFT) 4*e* that control switching the pixel electrodes 4*d*; a planar-shaped opposing electrode 4*f* disposed opposite the pixel electrodes 4*d* on the transparent substrate 4*a* side of the opposing substrate 4*b*; an orientation film 4*g* disposed covering the pixel electrodes 4*d* and opposing electrode 4*f*; liquid crystals 4*h* sealed in the spaces formed by the seal 4*c* and orientation film 4*g*; and a light source 4*j* that is disposed on the opposite side of the transparent substrate 4*a* as the TFTs 4*e*, and emits white light 10 toward the liquid crystals 4*h*.

The pixel electrodes 4*d*, opposing electrode 4*f*, and orientation film 4*g* are made of transparent materials. The liquid crystals 4*h* display information by passing or blocking the light 10 from the light source 4*j* as controlled by the TFTs 4*e* switching the pixel electrodes 4*d*. The LCD panel unit 4 is thus a so-called transmissive LCD device.

The LCD panel unit 4 also has a flexible circuit 4*n* that is externally connected through a connector 4*m*, and the flexible circuit 4*n* is connected to the surface of the circuit board 20 on the LCD panel unit 4 side (FIG. 2). The light source 4*j* supplies light to the liquid crystals 4*h* through the pixel electrodes 4*d* using organic electroluminescence. Alternatively, a configuration that does not use pixel electrodes 4*d* is also conceivable. In this configuration an organic LED (OLED) is disposed in place of the pixel electrodes 4*d* described above, and the OLEDs are switched individually. Further alternatively, the light source 4*j* could be a configuration that guides light from a lamp through a light guide to the entire surface of the liquid crystals 4*h*.

The LCD panel unit 4 also has a retardation film, polarizer, or other layers (not shown in the figure), for example, disposed in a specific alignment according to the type of liquid crystals 4*h* used, or more specifically according to the operating mode (twisted nematic (TN) or super twisted nematic (STN), for example), and display type (normally white mode or normally black mode) of the liquid crystals 4*h*. Further alternatively, if the LCD panel unit 4 is a color display, red (R), green (G), and blue (B) filters can be disposed to the opposing substrate 4*b* in areas opposite the pixel electrodes 4*d*.

Yet further alternatively, the LCD panel unit 4 could be a reflective LCD panel that has a reflector instead of a light source 4*j*, and reflects light from the opposing substrate 4*b* side.

The circuit configuration of an electronic wristwatch 1 with a GPS receiver function is described next. As shown in FIG. 4, the electronic wristwatch 1 includes an antenna unit 2, receiver module 30, display unit 80 including a control unit 40, and a battery 18.

The receiver module 30 is connected to the antenna unit 2, and includes a SAW (surface acoustic wave) filter 35, RF (radio frequency) unit 50, and baseband unit 60. The SAW filter 35 extracts the satellite signal from the radio waves received by the antenna unit 2. The RF unit 50 includes a LNA (low noise amplifier) 51, mixer 52, VCO (voltage controlled oscillator) 53, PLL (phase locked loop) circuit 54, IF (intermediate frequency) amplifier 55, IF filter 56, analog/digital converter (A/D converter) 57.

The satellite signal extracted by the SAW filter 35 is amplified by the LNA 51, and mixed with a local signal output by the VCO 53 and down-converted to an intermediate frequency signal. The PLL circuit 54 phase compares a stable reference clock signal with a signal obtained by frequency dividing the local signal output of the VCO 53, and synchronizes the local signal output from the VCO 53 with the reference clock signal to stabilize the local signal. The mixed signal output from the mixer 52 is amplified by the IF amplifier 55, and extraneous signal components are removed by the IF filter 56. The signal output from the IF filter 56 is then converted to a digital signal by the A/D converter 57.

The baseband unit 60 includes a DSP (digital signal processor) 61, CPU (central processing unit) 62, SRAM (static random access memory) 63, and RTC (real-time clock) 64. A temperature-compensated crystal oscillator (TCXO) 65 and flash memory 66 are also connected to the baseband unit 60.

The TCXO 65 generates a reference clock signal of a specific frequency that is substantially constant regardless of temperature. Current location information and time zone information are stored in flash memory 66. When set to the timekeeping means, the baseband unit 60 executes a process that demodulates the baseband signal from the digital signal output by the A/D converter 57 of the RF unit 50. The baseband unit 60 also extracts satellite information including the orbit information and GPS time information contained in the navigation message of the locked GPS satellite 90, and stores the information in SRAM 63.

The display unit 80 includes the control unit 40 and a crystal oscillator 43. The control unit 40 includes a storage unit 41, oscillation circuit 42, and drive circuit 44, and controls various operations. The control unit 40 controls the receiver module 30, sends control signals to the receiver module 30, controls the reception operation of the receiver module 30, and controls displaying information on the LCD panel unit 4 through the drive circuit 44 in the control unit 40. Internal time information and other information is stored in the storage unit 41.

The control unit 40, CPU 62, and DSP 61 work together to calculate time and location information, and derive the current time, current location, distance travelled, and speed of travel from the calculated information. The control unit 40 also controls this information on the LCD panel unit 4, and controls setting the operating mode and display mode of the electronic wristwatch 1 according to operation of the buttons 16. Advanced functions such as a navigation function that displays the current location on a map can also be provided.

The battery 18 supplies the energy required by circuit operations and the display. Energy is supplied from the battery 18 through a filter 17. This filter 17 is a band-stop filter that rejects frequencies in the reception signal frequency band, and rejects signals of the reception signal frequency that are induced in the battery 18 at the reception signal frequency. Thin lines are often used for wiring from the battery 18 to the circuits, particularly the receiver module 30 and display unit 80. These thin lines do not have the capacity to carry high frequencies such as the reception signal, and the function of the band-stop filter can also be provided by these lines. In such implementations the function of the filter 17 is rendered by the wiring lines, and the filter 17 can be omitted.

The antenna unit 2 incorporated in the electronic wristwatch 1 must be able to receive satellite signals from a plurality of GPS satellites 90 (FIG. 1). Because the radio waves of the satellite signals transmitted from the GPS satellites 90 are circularly polarized waves, the antenna unit 2 is preferably an antenna suited to receiving circularly polarized waves, and is further preferably compactly configured to enable inclusion in the electronic wristwatch 1. A compact antenna unit 2 such as described below and the circuit board 20 are disposed between the LCD panel unit 4 and the battery 18 in the electronic wristwatch 1 according to the invention (FIG. 2).

Figure 5A:
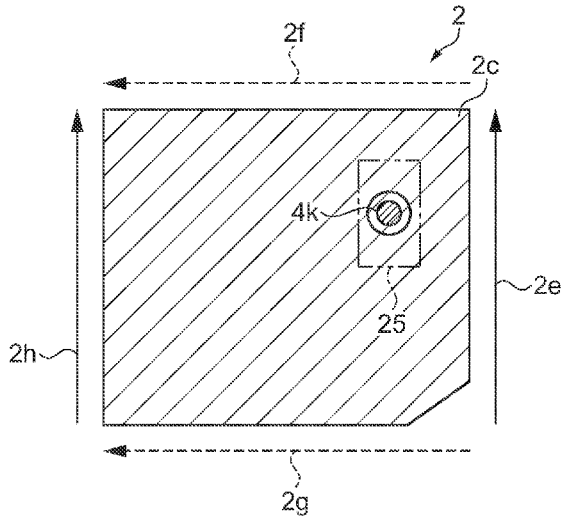
FIG. 5A is a plan view of the antenna unit from the ground conductor side.
Figure 5B:
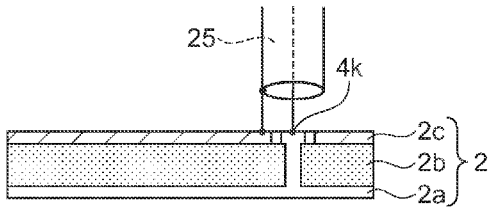
FIG. 5B is a section view showing the configuration of the power supply to the antenna unit.
Figure 5C:
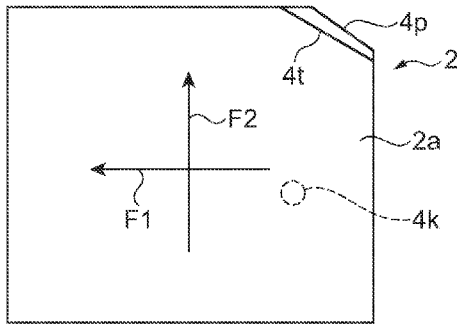
FIG. 5C is a plan view describing excitation modes in the radiating conductor of the antenna unit.

FIG. 5A is a plan view of the antenna unit 2 from the side near the circuit board 20, FIG. 5B is a section view showing the power supply configuration for the antenna unit, and FIG. 5C is a plan view describing excitation modes in the conductor of the antenna unit near the wrist 8.

A patch antenna of the related art is configured with a large ground conductor and a radiating conductor to which power is supplied from the ground conductor side through a dielectric layer 2*b*. In the antenna unit 2 according to this embodiment of the invention, the ground conductor and radiating conductor of the conventional patch antenna, and the dielectric layer 2*b*, are substantially identical in size and shape, and the conductors cannot be differentiated as ground and radiating conductors as they can in the patch antenna of the related art. For convenience below, the conductor (referred to as conductor 2*c* above) on the side shown in FIG. 5A, that is, the conductor on the side to which the conductor on the opposite side (conductor 2*a* above) is connected, is referred to below as the ground conductor 2*c*, and the conductor 2*a* on the opposite side is referred to as the radiating conductor 2*a*. The radiating conductor 2*a* is connected to the ground conductor 2*c* through a through-hole. The antenna unit 2 includes the radiating conductor 2*a*, the ground conductor 2*c* positioned on the opposite side as the radiating conductor 2*a*, and the dielectric layer 2*b* disposed between the radiating conductor 2*a* and ground conductor 2*c*.

The feed pin 4*k* disposed to the ground conductor 2*c* side of the antenna unit 2 is inserted from the ground conductor 2*c* through the dielectric layer 2*b* and connected to the radiating conductor 2*a*. The feed pin 4*k* in this embodiment is round with a 1 mm diameter, and is isolated from the ground conductor 2*c*. The part that passes the through-hole through the dielectric layer 2*b* is a 0.5 mm diameter circular column. The center conductor of the coaxial cable 25 is connected to the feed pin 4*k*. The outer conductor of the coaxial cable 25 is connected to the ground conductor 2*c* proximally surrounding the feed pin 4*k*. The antenna unit 2 is connected to the receiver module 30 by connecting other end of the coaxial cable 25 center conductor to the signal terminal 36 of the circuit board 20, and connecting the outer conductor to the ground potential of the circuit board 20. The radiating conductor 2*a* is thus connected through the feed pin 4*k* to the signal terminal 36 of the circuit board 20. The ground conductor 2*c* of the antenna unit 2 is also connected to the ground potential of the conductor with the largest surface area of all conductors on the circuit board 20.

The radiating conductor 2*a* is rectangular (substantially a quadrangle) with a triangular truncation 4*p* formed at one corner, and normally functions when made of a conductor such as copper, aluminum, iron, gold, steel, palladium, or indium tin oxide (ITO), or an alloy thereof, and in this embodiment is made by forming 10 μm thick copper (Cu) plating on the surface of the dielectric layer 2*b*. The through-hole portion passing through the dielectric layer 2*b* is formed at the same time by copper (Cu) plating. The frequency of the radiating conductor 2*a* can also be individually adjusted by creating a trimming portion 4*t* removing part of the copper (Cu) plating near the truncation 4*p*.

The ground conductor 2*c* is also a rectangle substantially identical to the radiating conductor 2*a*, and including the feed pin 4*k* is formed at the same time by 10 μm thick copper (Cu) plating. The area of the radiating conductor 2*a* that receives radio waves can therefore be maximized if the feed pin 4*k* is on the ground conductor 2*c* side. The coaxial cable 25 can also be connected to the reception signal input unit on the circuit board 20, that is, the SAW filter 35, using the shortest length of cable; loss from the coaxial cable 25 and the effect of wiring on field distribution near the antenna unit 2 can be minimized; and good antenna performance can be maintained.

The dielectric layer 2*b* is a rectangle of substantially the same size as the radiating conductor 2*a*, and examples of usable materials include ceramics such as alumina ($Al_2O_3$), mullite ($3Al_2O_3$-$2SiO_2$), stealite ($MgO—SiO_2$), forsterite ($2Mg_2O—SiO_2$), zirconia (PSZ), and magnesium titanate ($MgTiO_3$).

The dielectric constant of the dielectric layer 2*b* is preferably 8≤22, and the dielectric dissipation factor is preferably ≤0.001. To achieve these properties, the size of the dielectric layer 2*b* in the electronic device is preferably 2 cm to 4 cm on one side when rectangular as in this electronic wristwatch 1. For reference, when the dielectric layer 2*b* is round, the diameter is preferably 2.5 cm-3.5 cm. In each implementation the thickness is preferably 0.05 mm-1.5 mm. In the electronic wristwatch 1 according to this embodiment of the invention, the dielectric layer 2*b* of the antenna unit 2 is an alumina ($Al_2O_3$) rectangle that is 0.8 mm thick, 2.7 cm on the short side, 3.2 cm on the long side, has a dielectric constant of 9.6 and a dielectric dissipation factor of 0.00014. The truncation 4*p* is made by cutting off a triangle that is 3 mm long on the short side of the rectangle and 3.5 mm on the long side. This truncation 4*p* can be formed at any desired number of the four corners of the dielectric layer 2*b*, or more specifically at 0 to 4 corners. The corners of the rectangle are preferably truncated for aesthetic reasons particularly when using a digital display. In such implementations an electronic device with a particularly attractive appearance can be achieved by truncating all four corners.

Receiving radio waves carrying positioning signals from the GPS satellites 90 by this antenna unit 2 is described next. Signals from the GPS satellites 90 use circularly polarized waves so that the signals can be received regardless of the direction the receiver is facing, which is particularly useful for mobile receivers. With circularly polarized waves, the direction of the field rotates with the passage of time. In general, an antenna can receive radio waves by current flowing in the same direction as the direction of the electric field of the radio waves. To receive circularly polarized waves, current flow through the antenna must rotate over time. The current flowing through the antenna can be made to rotate by passing current in perpendicular directions to produce excitation with a 90 degree phase difference. Circularly polarized waves can be received by the antenna unit 2 by producing two excitation modes with a 90 degree phase difference in the radiating conductor 2*a* as described below.

As shown in FIG. 5C, the antenna unit 2 is a pin-feed antenna that receives power at the feed pin 4*k*. This is a simple design that can produce excitation modes without using special circuit elements in the feed system, and can easily receive circularly polarized waves. When radio waves are received in this antenna unit 2, current flows in excitation mode F1 in the direction of the long side, and current flows orthogonally to the excitation mode F1 in the direction of the short side in excitation mode F2. In other words, the position of the feed pin 4*k* in the configuration of the antenna unit 2 can be set to produce excitation modes F1 and F2. Excitation in excitation mode F1 and excitation mode F2 differs according to the rectangular shape of the radiating conductor 2*a*, and by adjusting the lengths of the short sides and long sides and the trimming portion 4*t*, the phase difference of excitation mode F1 and excitation mode F2 can be easily controlled, and circularly polarized waves can be received. A trimming portion 4*t* can also be provided at the desired number and locations of the four corners of the radiating conductor 2*a* or ground conductor 2*c*. The locations and number of trimming portions 4*t* can also be determined according to the convenience of adjustment during production.

To meet specific design requirements such as a particularly small size or the external design of the device in which the antenna unit 2 is used, the outside shape of the antenna unit 2 may also necessarily be rectangular with a large length to width ratio. In this implementation the resonance frequencies of excitation mode F1 and excitation mode F2 will differ greatly, but linear polarized waves can still be received by adjusting the resonance frequency of the excitation mode F1 on the long axis to the desired reception frequency. Alternatively, excitation mode F2 can obviously be adjusted to the desired reception frequency, but this also increases the size of the antenna unit 2. That the frequency can be matched to excitation mode F2 means that the size of the antenna can be increased, in which case circularly polarized waves can be received.

When radio waves reach the antenna unit 2, surface current flowing along the ground conductor 2*c* and radiating conductor 2*a* is induced, and a reception signal is acquired by this current at the feed pin 4*k*. The surface currents flowing along the ground conductor 2*c* and radiating conductor 2*a* each have a distribution with a two-dimensional spread, and the distribution differs according to the excitation mode F1, F2. As shown in FIG. 5A, these current distributions can be converted to linear distributions assuming magnetic currents 2*e*, 2*f*, 2*g*, 2*h* flowing along the outside edges of the antenna unit 2. Magnetic currents 2*e*, 2*h* are induced in excitation mode F1, and magnetic currents 2*f*, 2*g* are induced in excitation mode F2. There must be sufficient clearance around the edges of the antenna unit 2 in order to not interfere with induction of these magnetic currents and maintain antenna performance.

Through simulations and tests, we found that severe effects on antenna performance can be prevented if this clearance is set as described below. The clearance is described with reference to FIG. 2.

A metal or other type of conductor must not be located within the following ranges: distance Δp to the outside in the planar direction from the outside edge of the antenna unit 2, distance Δc to the inside in the planar direction from the outside edge of the antenna unit 2, and distance Δe above the ground conductor 2*c* and below radiating conductor 2*a* of the antenna unit 2. If a conductor is located within these areas, antenna performance will degrade significantly.

Specific values for Δp, Δc, and Δe are, respectively, ≤2/100, ≥0.5/100, and ≥0.5/100 the wavelength of the radio waves that are received. In other words, the distance Δp between the outside edge of the smaller of the radiating conductor 2*a* and ground conductor 2*c* of the antenna unit 2, and the outside edge of the larger of the circuit board 20 and LCD panel unit 4 stacked with the antenna unit 2, must be ≤2/100 of the wavelength of the received radio waves. Preferably, the antenna unit 2 is disposed so that Δp=0 or Δp≤0 as indicated by $\Delta p_1$ in oval 81 in excitation mode F2. More specifically, Δp=0 is particularly preferable because packaging efficiency is greatest.

A clearance of at least Δe=0.5/100 wavelength is also required above the ground conductor 2*c* and below the radiating conductor 2*a* in the areas within Δp to the outside and Δc to the inside of the outside edge of the antenna unit 2. Both Δc and Δe are preferably ≥1/100 wavelength. Note that a battery 18 that is typically smaller than the antenna unit 2 is disposed below the radiating conductor 2*a*, this clearance requirement is met naturally, and Δp, Δc, and Δe are not shown there in the figure. In addition, Δc and Δe are omitted from the right side of the figure, that is, inside oval 81. Of the clearances in these three directions, the effect of Δp is particularly great, and it is important that Δp≤2/100 wavelength. If linear polarized waves are received by a rectangular antenna unit 2 with a large length to width ratio in order to meet specific design requirements such as the need for a particularly small size or a specific external device design, the foregoing clearances must be provided at least on the short sides of the rectangle.

Packaging efficiency is greatest in the electronic wristwatch 1 if the antenna unit 2, LCD panel unit 4, and circuit board 20 all have substantially the same outside shape. If the packaging structure described above is used for the antenna unit 2 according to this embodiment of the invention, the above clearances can be easily assured even when the antenna unit 2, LCD panel unit 4, and circuit board 20 have the same shape, packaging efficiency is good and an electronic wristwatch 1 with good reception performance can be achieved. More specifically, even if the antenna unit 2, LCD panel unit 4, and circuit board 20 have substantially the same outside shape, the antenna unit 2 is substantially unaffected by the effect of the LCD panel unit 4 and circuit board 20 at the outside edge of the antenna unit 2, and magnetic currents 2*e*, 2*h*, 2*f*, 2*g* (FIG. 5A) can be created. As a result, the antenna unit 2 can reliably receive radio waves from GPS satellites 90 as a reception unit. This is substantially the same whether the antenna unit 2 is larger than the outside shape of the LCD panel unit 4, that is, when Δp<0, and when the antenna unit 2 is smaller than the LCD panel unit 4 if Δp≤2/100 wavelength.

As described above, the LCD panel unit 4, circuit board 20, antenna unit 2, and battery 18 of the electronic wristwatch 1 are disposed in this order from the face (crystal 12) side to the wrist 8 in this embodiment of the invention. Because the LCD panel unit 4 and circuit board 20 are disposed close together, and the flexible circuit 4*n* that connects the LCD panel unit 4 and circuit board 20 does not pass around the side surfaces of the antenna unit 2 in the electronic wristwatch 1 configured as described above, the antenna unit 2 is not exposed to the adverse effects of being concealed by the flexible circuit, for example, and reception performance is improved.

The LCD panel unit 4 is also shielded from the antenna unit 2 by the ground plane, which is the largest of the conductors formed on the circuit board 20. Noise from the LCD panel unit 4 is thus prevented from reaching the antenna unit 2, and good reception performance can be assured.

The ground conductor 2*c* of the antenna unit 2 is on the circuit board 20 side, and the radiating conductor 2*a* is connected to the feed pin 4*k* on the circuit board 20 side through a through-hole. The antenna unit 2 can therefore be easily connected to the circuit board 20. The ground potential of the circuit board 20 is also connected to the ground conductor 2*c*, the ground conductor 2*c* therefore goes to the same potential as the high profile shield 21 on the back of the circuit board 20 and the ground potential occupying a large area on the circuit board 20, and good reception performance can be assured even if the ground conductor 2*c* is close to the circuit board 20, and particularly to the shield 21 on the circuit board 20, with little interference therefrom.

Furthermore, because the radiating conductor 2*a* to which the signal terminal 36 (FIG. 4) that inputs the reception signal is connected is physically remote from the LCD panel unit 4 that easily produces noise, and the ground plane is disposed therebetween, reception performance can be maintained even when the electronic wristwatch 1 is small. The battery 18 is also located closest to the back cover 13 on the opposite side as the LCD panel unit 4, and can be easily replaced.

The electronic wristwatch 1 according to this embodiment of the invention can be divided at the dielectric layer 2*b* of the antenna unit 2 into two parts, a first group including the ground conductor 2*c*, circuit board 20, and LCD panel unit 4 located above (on the face side) this boundary, and a second group including the radiating conductor 2*a* and battery 18 below the boundary. The parts in each of these groups go to the same potential at the reception frequency. More specifically, the parts in the first group are at the ground potential of the circuit board 20 at the reception frequency, and the parts in the second group, and the wrist 8, which is a good conductor, go to the potential of the signal terminal 36 of the receiver module 30. The potential of the battery is treated as the ground potential of the circuit board 20 in direct current, but is separated by the filter 17 in the reception frequency band and goes to the potential of the signal terminal 36 by capacitive coupling between the radiating conductor 2*a* and battery 18. Because the potential is clearly separated by the dielectric layer 2*b* of the antenna unit 2 in the configuration of this embodiment, the adverse effect of parts near the antenna unit 2 on antenna performance can be eliminated. Furthermore, if the back cover 13 is made from metal or other conductive material, the user's skin, which is a good conductor, can be used as the ground potential, the electrical size of the antenna unit 2 can be increased, and antenna performance can be further improved.

As described above, the radiating conductor 2*a* and ground conductor 2*c* are substantially identically shaped, and which is called the radiating conductor is a matter of convenience only. Which is referred to as the radiating conductor is determined by the outside shape of the antenna unit 2. Considering antenna operation, the conductor in the second group including the body of the user may be thought of as the ground conductor, and the conductor in the first group as the radiating conductor.

Embodiment 2

Figure 6:
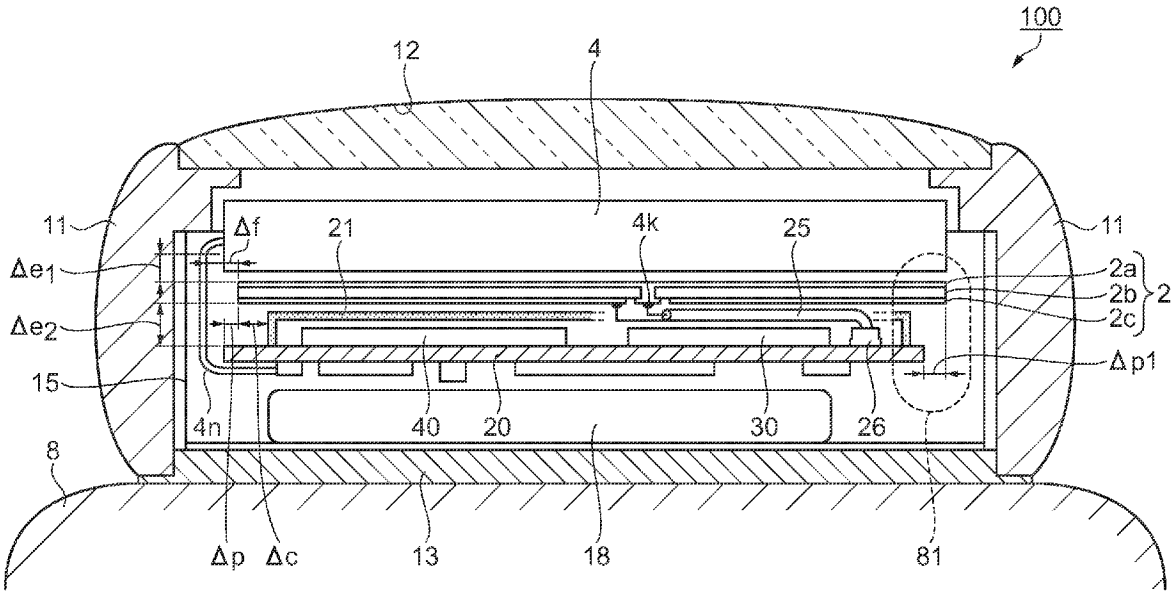
FIG. 6 is a section view of a configuration including an antenna unit in an electronic wristwatch according to a second embodiment of the invention.

The configuration of an antenna unit in a second embodiment of the invention is described next. FIG. 6 is a section view showing the configuration of an electronic wristwatch according to the second embodiment of the invention. In this second embodiment the orientation and locations of the antenna unit 2 and the circuit board 20 are different from in the first embodiment. Note that parts with the same function in the electronic wristwatch 100 according to this second embodiment and the foregoing first embodiment are identified by like reference numerals, further description thereof is omitted, and only parts that differ from the first embodiment are described below.

The LCD panel unit 4, antenna unit 2, circuit board 20, battery 18, and back cover 13 are disposed in order from the crystal 12 side of the electronic wristwatch 100 according to this embodiment of the invention. The radiating conductor 2*a* of the antenna unit 2 is disposed opposite the LCD panel unit 4, and is connected to the ground conductor 2*c* side by the feed pin 4*k* passing through a through-hole opened in the dielectric layer 2*b*. The feed pin 4*k* is connected to the center conductor of the coaxial cable 25, and the outer conductor of the coaxial cable 25 is connected to the ground conductor 2*c* in proximity to the feed pin 4*k*. The outer conductor of the coaxial cable 25 may be connected surrounding the feed pin 4*k*. At the other end of the coaxial cable 25, that is, the end connected to the circuit board 20, the center conductor of the coaxial cable 25 is connected to the signal terminal 36 of the receiver module 30, and the outer conductor is connected to the ground potential of the circuit board 20, through a connector 26. More specifically, the feed pin 4*k* is connected to the signal terminal 36 of the receiver module 30 by the coaxial cable 25.

The LCD panel unit 4 and the drive circuit 44 on the circuit board 20 are connected through the flexible circuit 4*n*. In FIG. 6 the flexible circuit 4*n* is connected to the opposite side of the circuit board 20 as the antenna unit 2, but could be connected to the side facing the antenna unit 2. However, clearance is required between the flexible circuit 4*n* and the outside edge of the antenna unit 2.

Simulations have also demonstrated that the clearances described below are required. These clearances are described with reference to FIG. 6.

A metal or other type of conductor must not be located within the following ranges: distance Δp to the outside in the planar direction from the outside edge of the antenna unit 2, distance Δc to the inside in the planar direction from the outside edge of the antenna unit 2, and distance Δe vertically from the antenna unit 2 (shown in the figure divided into clearance $\Delta e_1$ between the radiating conductor 2*a* of the antenna unit 2 and the pixel electrodes 4*d* (conductors) on the LCD panel unit 4, and clearance $\Delta e_2$ between the ground conductor 2*c* of the antenna unit 2 and any conductor on the circuit board 20). If a conductor is located within these areas, antenna performance will degrade significantly.

Specific values for Δp, Δc, and Δe (both $\Delta e_1$ and $\Delta e_2$) are, respectively, ≤2/100, ≥0.5/100, and ≥0.5/100 the wavelength of the radio waves that are received. In other words, the distance Δp between the outside edge of the smaller of the radiating conductor 2*a* and ground conductor 2*c* of the antenna unit 2, and the outside edge of the larger of the circuit board 20 and LCD panel unit 4 stacked with the antenna unit 2, must be ≤2/100 of the wavelength of the received radio waves. Preferably, the antenna unit 2 is disposed so that Δp=0 or Δp≤0 as indicated by $\Delta p_1$ in oval 81 in excitation mode F2. More specifically, Δp=0 is particularly preferable because packaging efficiency is greatest. The flexible circuit 4*n* must also be separated at least Δf=2/100 wavelength from the outside edge of the antenna unit 2.

A clearance of at least Δe=0.5/100 wavelength is also required above the ground conductor 2*c* and below the radiating conductor 2*a* in the areas within Δp to the outside and Δc to the inside of the outside edge of the antenna unit 2. Both Δc and Δe are preferably ≥1/100 wavelength. Of the clearances in these three directions, the effect of Δp is particularly great, and it is important that Δp<2/100 wavelength. If linear polarized waves are received by using an antenna unit 2 with an extreme substantially rectangular shape, a clearance of Δp<2/100 wavelength is required at least from the short sides of the antenna unit 2.

The LCD panel unit 4 can be disposed in direct contact with the radiating conductor 2*a* in the configuration of the electronic wristwatch 100 according to this embodiment of the invention, and maintaining the above clearance Δe may seem difficult. However, because the back side of the LCD panel unit 4 is composed of non-conductive members such as the transparent substrate 4*a* and a light source 4*j* that only needs to illuminate inside the area surrounded by the seal 4*c* as shown in FIG. 3B, Δe can be easily maintained. Replacing the battery 18 is also simple because the battery 18 is located just inside the back cover 13. The battery 18 in this configuration also does not affect operation of the antenna unit 2.

The antenna unit 2 is disposed to a position separated from the wrist with the configuration and connection used in this electronic wristwatch 100. As a result, the effect of the wrist when the electronic wristwatch 100 is worn on the wrist can therefore be reduced. In addition, because the radiating conductor 2*a* is on the opposite side as the wrist and the ground conductor 2*c* is on the side toward the wrist, the LCD panel unit 4, circuit board 20, and battery 18 are equal to the ground potential of the circuit board 20 at the operating frequency. As a result, the ground conductor 2*c*, and all components below the dielectric layer 2*b* of the antenna unit 2, including the ground conductor 2*c*, the ground plane of the circuit board 20, and the battery 18, go to the ground potential of the circuit board 20. These also go the same potential and form a large ground plane through the capacitance between the wrist 8 and the battery 18. The radiating conductor 2*a* also faces the zenith (the direction toward the face of the electronic wristwatch 100), and together with the large ground plane enables efficient antenna operation. If the back cover 13 is made of metal or other conductive member, an even more efficient ground plane can be created and performance further improved.

Comparing the electronic wristwatch 100 according to this embodiment with the electronic wristwatch 1 of the first embodiment, the ground conductor 2*c* goes to the same potential as the wrist, which is a more natural configuration. However, the radiating conductor 2*a* is proximal to the LCD panel unit 4, and can be easily affected by noise from the LCD panel unit 4. The LCD panel unit 4 is also at the ground potential of the circuit board 20, and the radiating conductor 2*a* is disposed surrounded by the ground potential. However, the effects of noise can be eliminated if the frequency of the clock used to drive the LCD panel unit 4 is set ideally, and more specifically is set so that a harmonic of the clock frequency does not match the reception frequency of the electronic wristwatch 100.

Furthermore, if the LCD panel unit 4 does not conceal the radiating conductor 2*a* with the ground potential, and more specifically in this embodiment does not conceal the magnetic currents flowing along the edges of the antenna unit 2. More specifically, if the clearances described above are maintained, antenna performance will not be severely degraded. As described above, a compact electronic wristwatch 100 that operates stably with little effect from the body when worn on the wrist, for example, can be achieved using the configuration described in this embodiment of the invention.

The electronic wristwatches 1, 100 described as examples of an electronic device according to the invention are not limited to the foregoing embodiments, and the same effects described above can be achieved with variations such as described below.

Variation 1

The antenna unit 2 and LCD panel unit 4 in the foregoing electronic wristwatches 1, 100 are substantially rectangular, but the invention is not so limited and could be round, oval, diamond-shaped, quadrilateral, polygonal, or other shape and function identically to the rectangular configurations described above.

Variation 2

The shape of the truncated part 4*p* of the antenna unit 2 is not limited to triangular, and could be a substantially U-shaped notch that is recessed to the inside of the antenna unit 2 from the outside edge, or a tab that protrudes out from the outside edge. The shape of the antenna unit 2 can therefore be made harmonious with the design of the electronic wristwatches 1, 100, for example.

Variation 3

Connecting the antenna unit 2 with the signal terminal 36 of the receiver module 30 is not limited to using a coaxial cable 25. A lead, coplanar guide, microstrip line, or lecher line, for example, could be used.

Variation 4

The electronic device of the invention is also not limited to an electronic wristwatch 1, 100, and could be a travel clock, pocket watch, or timepiece used in a mobile electronic device with an antenna unit 2. The invention can also be applied in mobile devices without a timekeeping function. For example, the invention can be used with health monitoring systems that are worn by the patient to collect biometric information and send the collected data by wireless communication to an external computer, as well as devices that are attached to and collect biometric data from wildlife for wildlife studies and other purposes.

Variation 5

The display unit is also not limited to an LCD panel unit 4, and display methods other than liquid crystal devices can be used, including organic electroluminescent (OEL) displays and electro-phoretic displays (EPD). An analog timepiece display including hands, a dial, a stepper motor that drives the hands, and a wheel train could also be used.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An electronic device comprising:

a digital display unit that displays information;

a circuit board disposed on one side of the digital display unit;

an antenna unit that does at least one of transmitting and receiving radio waves, is disposed on the opposite side of the circuit board as the digital display unit, and includes a planar-shaped dielectric layer, a first conductive layer disposed on one side of the dielectric layer, and a second conductive layer disposed on the other side of the dielectric layer; and a battery that is disposed on the opposite side of the antenna unit as the circuit board and supplies power;

wherein the first conductive layer is disposed on the surface of the dielectric layer on the side near the circuit board, and is connected to the ground potential of the circuit board, and the second conductive layer is disposed on the surface of the dielectric layer on the side far from the circuit board, and is connected to the signal potential of the circuit board;

wherein the digital display unit is positioned above the antenna unit relative to a viewing direction of the electronic device, and wherein the digital display unit, the circuit board and the antenna unit are substantially the same size.

2. The electronic device described in claim 1, wherein:

the shape of the dielectric layer of the antenna unit, and the shape of at least one of the first conductive layer and the second conductive layer, is a rectangle with n (where n is 0, 1, 2, 3, or 4) truncated corners, and at least a short side of the rectangle is disposed outside of a position 2/100 wavelength of the radio wave inside from the outside edge of the larger of the conductors formed on the digital display unit or the circuit board.

3. An electronic device comprising:

a digital display unit that displays information;

an antenna unit that does at least one of transmitting and receiving radio waves, is disposed on one side of the digital display unit, and includes a planar-shaped dielectric layer, a first conductive layer disposed on one side of the dielectric layer, and a second conductive layer disposed on the other side of the dielectric layer;

a circuit board disposed on the opposite side of the antenna unit as the digital display unit; and a battery that is disposed on the opposite side of the circuit board as the antenna unit and supplies power;

wherein the first conductive layer is disposed on the surface of the dielectric layer on the side near the circuit board, and is connected to the ground potential of the circuit board, and the second conductive layer is disposed on the surface of the dielectric layer on the side far from the circuit board, and is connected to the signal potential of the circuit board;

wherein the digital display unit is positioned above the antenna unit relative to a viewing direction of the electronic device, and wherein the digital display unit, the circuit board and the unit are substantially the same size.

* * * * *